US008317741B2

(12) United States Patent
Kraushaar

(10) Patent No.: US 8,317,741 B2
(45) Date of Patent: Nov. 27, 2012

(54) APPARATUS AND METHODS FOR ADMINISTRATION OF RECONSTITUTED MEDICAMENT

(76) Inventor: Timothy Y. Kraushaar, Seal Beach, CA (US)

( * ) Notice: Subject to any disclaimer, the term of this patent is extended or adjusted under 35 U.S.C. 154(b) by 583 days.

(21) Appl. No.: 12/471,749

(22) Filed: May 26, 2009

(65) Prior Publication Data

US 2010/0305548 A1 Dec. 2, 2010

(51) Int. Cl.
*A61M 37/00* (2006.01)

(52) U.S. Cl. ..... 604/82; 604/158; 604/6.1; 604/99.03; 604/167.04

(58) Field of Classification Search ..... 604/82, 604/158, 6.1, 99.03, 167.04, 518
See application file for complete search history.

(56) References Cited

U.S. PATENT DOCUMENTS

| | | | | |
|---|---|---|---|---|
| 1,854,307 | A | 4/1932 | Hapgood | |
| 2,854,027 | A | 9/1958 | Kaiser et al. | |
| 2,907,349 | A | 10/1959 | White | |
| 3,012,752 | A | 12/1961 | Buck | |
| 3,405,601 | A | 10/1968 | Clarke | |
| 3,678,960 | A | 7/1972 | Leibinsohn | |
| 3,957,082 | A | 5/1976 | Fuson et al. | |
| 4,275,823 | A | 6/1981 | Credle, Jr. | |
| 4,397,335 | A | 8/1983 | Doblar et al. | |
| 4,669,503 | A | 6/1987 | McGarrity et al. | |
| 4,857,068 | A * | 8/1989 | Kahn | 604/405 |
| 5,334,163 | A | 8/1994 | Sinnett | |
| 5,445,187 | A | 8/1995 | Farquhar | |
| 5,578,016 | A | 11/1996 | Zinger | |
| 5,658,248 | A | 8/1997 | Klein et al. | |
| 5,927,560 | A | 7/1999 | Lewis et al. | |
| 6,158,467 | A | 12/2000 | Loo | |
| 6,221,041 | B1 * | 4/2001 | Russo | 604/82 |
| 6,418,966 | B2 | 7/2002 | Loo | |
| 6,457,488 | B2 * | 10/2002 | Loo | 137/625.47 |
| D483,487 | S | 12/2003 | Harding et al. | |
| 6,953,450 | B2 * | 10/2005 | Baldwin et al. | 604/248 |

(Continued)

OTHER PUBLICATIONS

International Search Report on corresponding PCT application (PCT/US2010/035439) from International Searching Authority (KIPO) dated Jan. 25, 2011.

(Continued)

*Primary Examiner* — Bhisma Mehta
*Assistant Examiner* — Edelmira Bosques
(74) *Attorney, Agent, or Firm* — Klein, O'Neill & Singh, LLP

(57) ABSTRACT

A body portion of the apparatus comprises an interior cavity and a plurality of fluid lumens extending from the cavity to a periphery of the body portion. The apparatus further comprises a first fluid port in fluid communication with a first one of the fluid lumens. The first fluid port is configured to receive a syringe for injecting a liquid diluent and withdrawing a reconstituted liquid medicament. The apparatus further comprises a second fluid port in fluid communication with a second one of the fluid lumens. The second fluid port is configured to receive a medicament vial. The apparatus further comprises a third fluid port at an end of a third one of the fluid lumens for expelling the reconstituted liquid medicament. The apparatus further comprises a stopcock received within the body portion interior cavity and configured to regulate fluid communication between the fluid lumens. The stopcock has a first position in which fluid communication between the fluid lumens is blocked, a second position in which fluid communication is open between the first and second fluid lumens and a third position in which fluid communication is open between the first and third fluid lumens.

23 Claims, 14 Drawing Sheets

U.S. PATENT DOCUMENTS

| | | | | |
|---|---|---|---|---|
| 2002/0017328 | A1 | 2/2002 | Loo | |
| 2003/0070726 | A1 | 4/2003 | Andreasson et al. | |
| 2004/0225274 | A1 | 11/2004 | Jansen et al. | |
| 2007/0106244 | A1* | 5/2007 | Mosler et al. | 604/411 |
| 2009/0198217 | A1* | 8/2009 | Thorne et al. | 604/518 |

OTHER PUBLICATIONS

Written Opinion on corresponding PCT application (PCT/US2010/035439) from International Searching Authority (KIPO) dated Jan. 25, 2011.

* cited by examiner

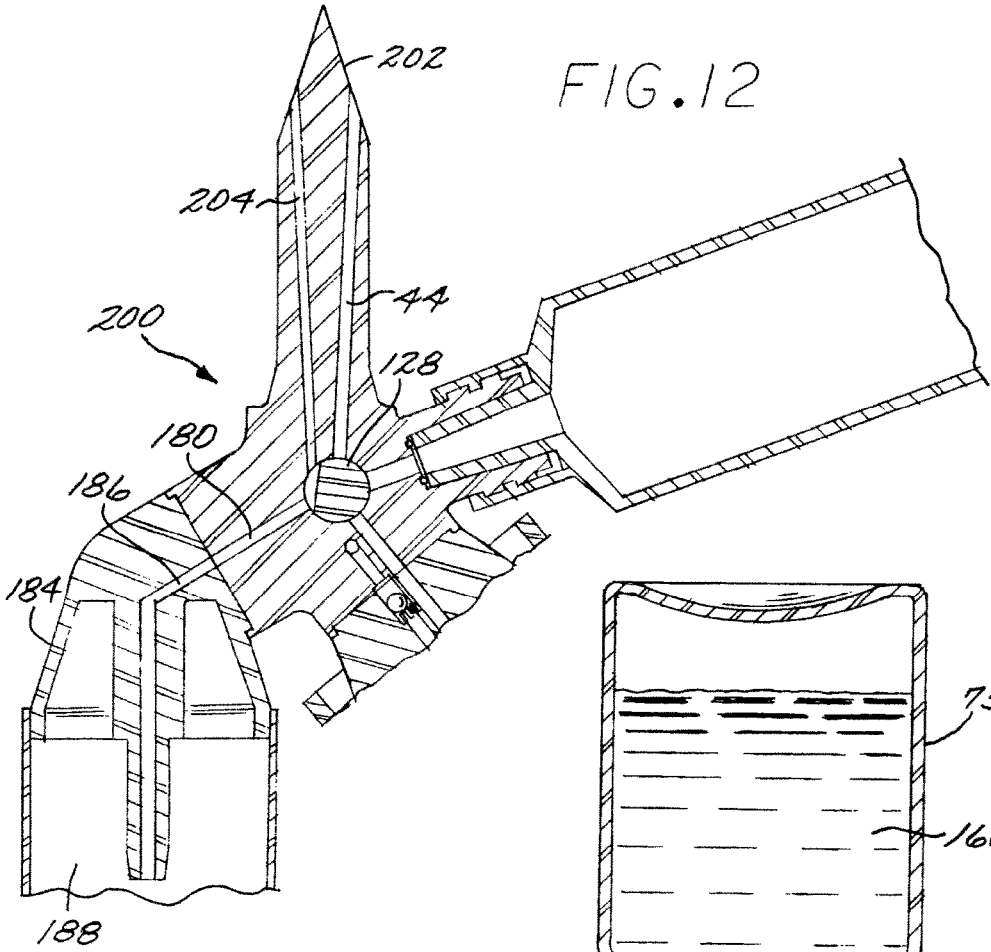
FIG. 12
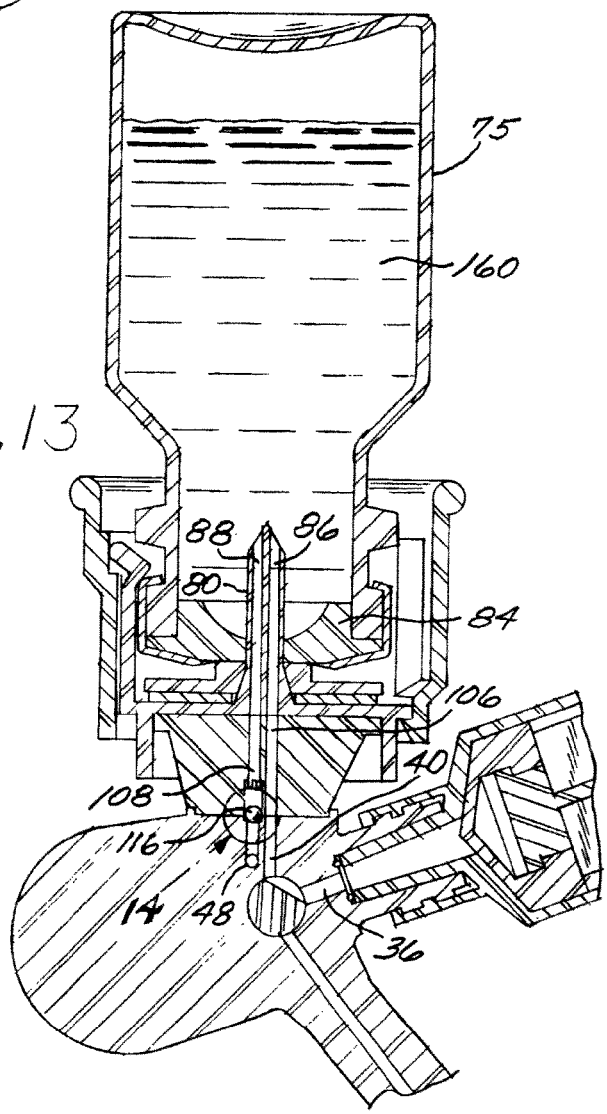
FIG. 13
FIG. 14
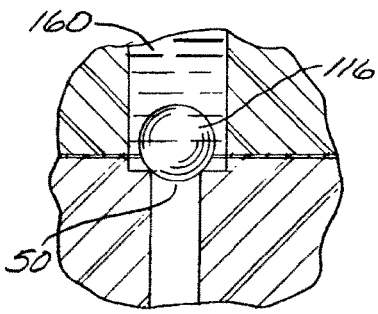

APPARATUS AND METHODS FOR ADMINISTRATION OF RECONSTITUTED MEDICAMENT

CROSS-REFERENCE TO RELATED APPLICATION

Not Applicable

FEDERALLY-SPONSORED RESEARCH OR DEVELOPMENT

Not Applicable

BACKGROUND

The present invention relates to the administration of medicament to a patient. More particularly, it relates to apparatus and methods for the administration of reconstituted medicaments; that is, medicaments that are packaged in concentrated or dehydrated form, and that must be diluted or reconstituted by the addition of a liquid constituent before administration to a patient.

Medicaments for administration to a patient by injection, such as many types of chemotherapy preparations, are sometimes packaged and shipped in a concentrated or dehydrated form, such as, for example, a dehydrated powder or a concentrated liquid. Before these dehydrated or concentrated medicaments can be administered to patients, they must be reconstituted. The reconstitution process involves adding a liquid rehydration or dilution component or constituent to the concentrated or dehydrated medicament. The reconstituted medicament is then administered to a patient. The administration may be direct, as through an injection by syringe, or indirect, as through injecting the reconstituted medicament into an intravenous (IV) bag, from which the medicament is delivered intravenously to the patient.

An important consideration in handling many such medicaments, particularly highly toxic chemotherapy preparations, is to minimize the release of the medicament to the ambient environment. Indeed, compliance with regulatory standards may necessitate near-zero release of medicament to the ambient environment. Consequently, there has been a long-sought need for a "closed" system for reconstituting and administration such medicaments, in which the medicament is reconstituted and administered under conditions of effective isolation from the environment.

SUMMARY

The various embodiments of the present apparatus and methods for reconstituting medicament have several features, no single one of which is solely responsible for their desirable attributes. Without limiting the scope of the present embodiments as expressed by the claims that follow, their more prominent features now will be discussed briefly. After considering this discussion, and particularly after reading the section entitled "Detailed Description" one will understand how the features of the present embodiments provide advantages, which include providing a closed system that reduces the likelihood of any potentially harmful medicament escaping to the ambient environment.

One aspect of the present apparatus and methods for reconstituting medicament includes the realization that some concentrated medicaments are highly toxic. Thus, it would be advantageous to patients and health care workers to be able to reconstitute concentrated medicaments using a closed system that reduces the likelihood of any toxic substances causing harm to a patient or a health care worker.

One embodiment of the present apparatus for reconstituting medicament comprises a body portion including an interior cavity and a plurality of fluid lumens extending from the cavity to a periphery of the body portion. The apparatus further comprises a first fluid port in fluid communication with a first one of the fluid lumens. The first fluid port is configured to receive a syringe for injecting a liquid diluent and withdrawing a reconstituted liquid medicament. The apparatus further comprises a second fluid port in fluid communication with a second one of the fluid lumens. The second fluid port is configured to receive a medicament vial. The apparatus further comprises a third fluid port at an end of a third one of the fluid lumens for expelling the reconstituted liquid medicament. The apparatus further comprises a stopcock received within the body portion interior cavity and configured to regulate fluid communication between the fluid lumens. The stopcock has a first position in which fluid communication between the fluid lumens is blocked, a second position in which fluid communication is open between the first and second fluid lumens, and a third position in which fluid communication is open between the first and third fluid lumens.

One embodiment of the present methods for reconstituting medicament comprises engaging a syringe with a first fluid port of apparatus for reconstituting medicament. The method further comprises engaging a medicament vial with a second fluid port of the apparatus. The method further comprises adjusting a stopcock of the apparatus to open fluid communication between the first and second fluid ports. The method further comprises injecting a liquid diluent from the syringe into the medicament vial through the first and second fluid ports. The method further comprises withdrawing a reconstituted liquid medicament from the medicament vial into the syringe through the first and second fluid ports. The method further comprises adjusting the stopcock to open fluid communication between the first fluid port and a third fluid port of the apparatus. The method further comprises expelling the reconstituted liquid medicament from the syringe into the apparatus and out of the third fluid port.

BRIEF DESCRIPTION OF THE DRAWINGS

The various embodiments of the present apparatus and methods for reconstituting medicament now will be discussed in detail with an emphasis on highlighting the advantageous features. These embodiments depict the novel and non-obvious apparatus and methods shown in the accompanying drawings, which are for illustrative purposes only. These drawings include the following figures, in which like numerals indicate like parts:

FIG. 12 is a front cross-sectional view of another embodiment of the present apparatus for reconstituting medicament including a spike having two fluid lumens;

FIG. 13 is a detail rear cross-sectional view of the apparatus of FIG. 5, showing the medicament vial inverted;

FIG. 14 is a detail view of the circled portion of FIG. 13, showing the ball in the check valve bearing against the fourth fluid port;

DETAILED DESCRIPTION

Figure 1:
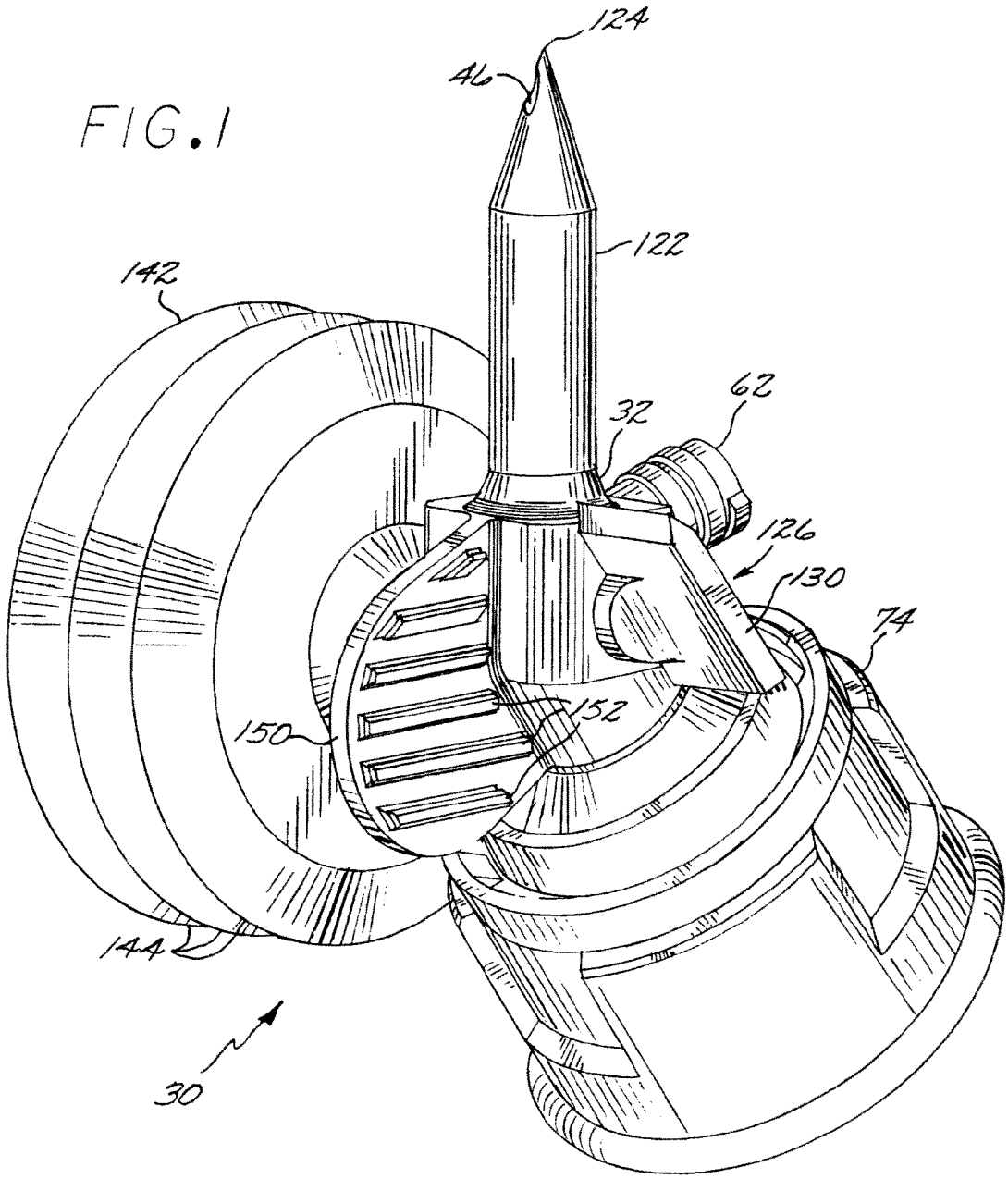
FIG. 1 is a front/left-side perspective view of one embodiment of the present apparatus for reconstituting medicament.

The following detailed description describes the present embodiments with reference to the drawings. In the drawings, reference numbers label elements of the present embodiments. These reference numbers are reproduced below in connection with the discussion of the corresponding drawing features.

As used herein, the term "reconstitute" is used broadly to describe a process through which a concentrated or dehydrated substance is converted to a diluted liquid form through the addition of a liquid constituent or diluent. Similarly, the term "reconstituted" describes a substance produced by reconstituting. Typically, the concentrated substance is dehydrated powder or concentrated liquid medicament and the liquid constituent or diluent is water or saline. However, the present embodiments are not limited to these substances.

The embodiments of the present apparatus for reconstituting medicament are described below with reference to the figures. These figures, and their written descriptions, indicate that certain components of the apparatus are formed integrally, and certain other components are formed as separate pieces. Those of ordinary skill in the art will appreciate that components shown and described as being formed integrally may in alternative embodiments be formed as separate pieces. Those of ordinary skill in the art will further appreciate that components shown and described as being formed as separate pieces may in alternative embodiments be formed integrally. Further, as used herein the term "integral" describes a single unitary piece.

Figure 2:
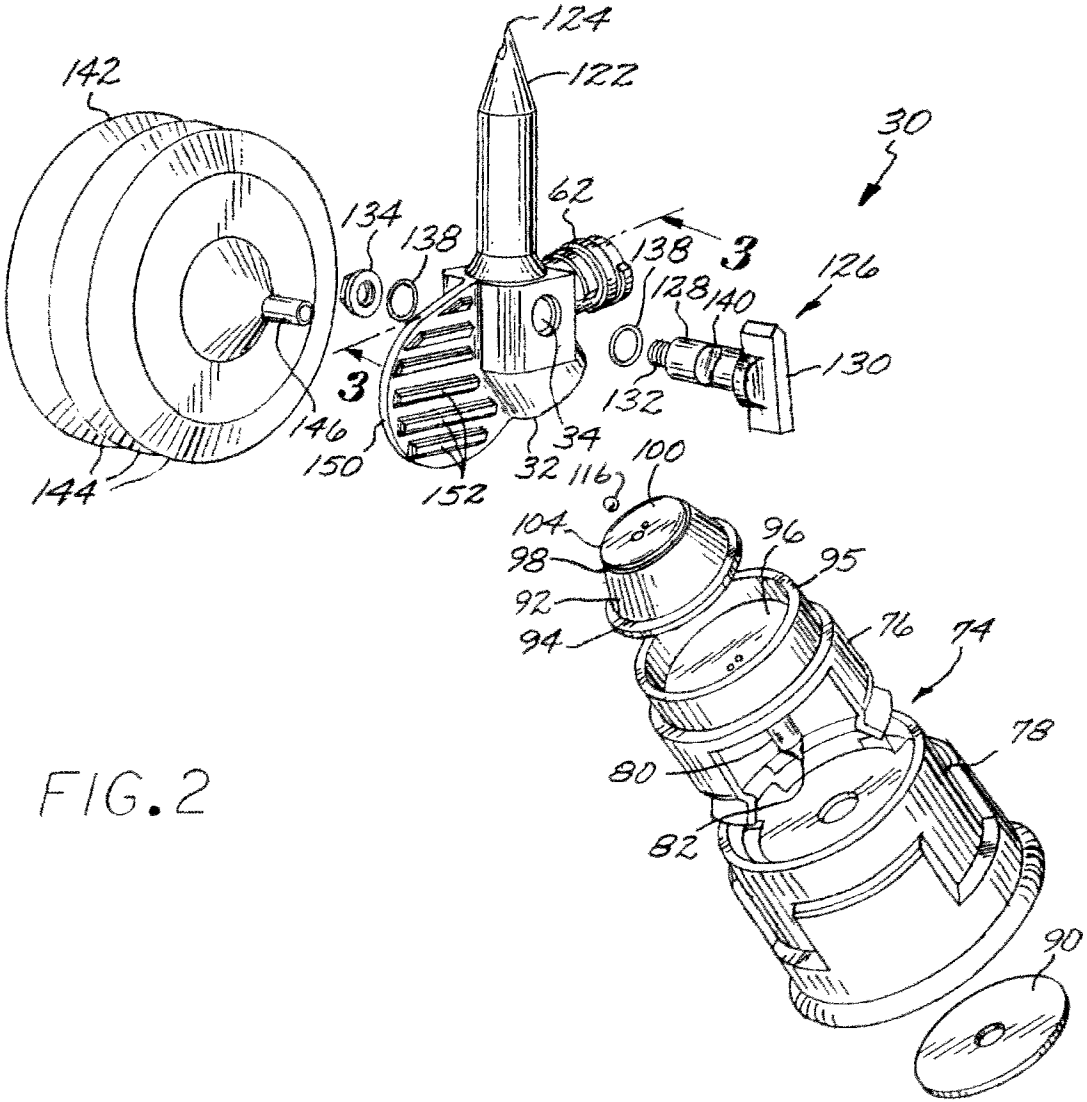
FIG. 2 is an exploded front/left-side perspective view of the apparatus of FIG. 1.
Figure 4:
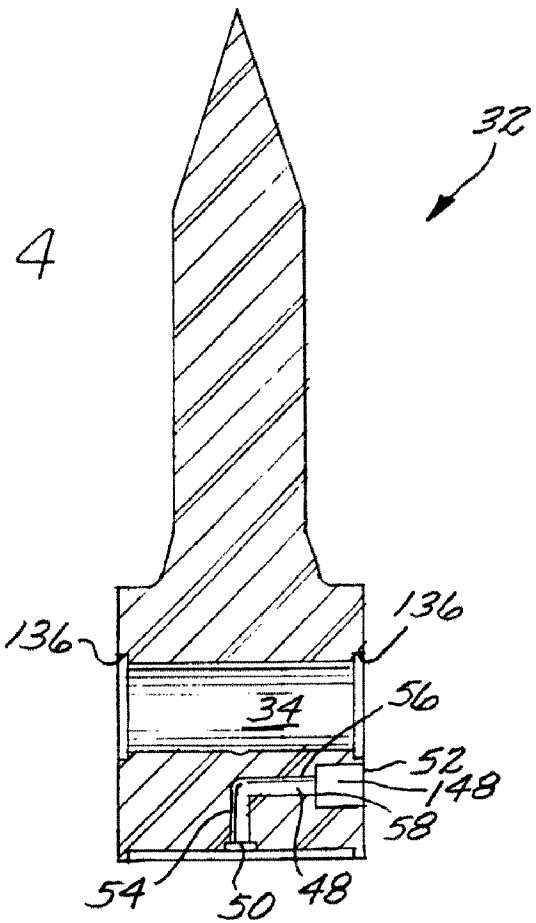
FIG. 4 is a right side cross-sectional view of the body portion of the apparatus of FIG. 2, taken through the line 4-4 in FIG. 3.
Figure 3:
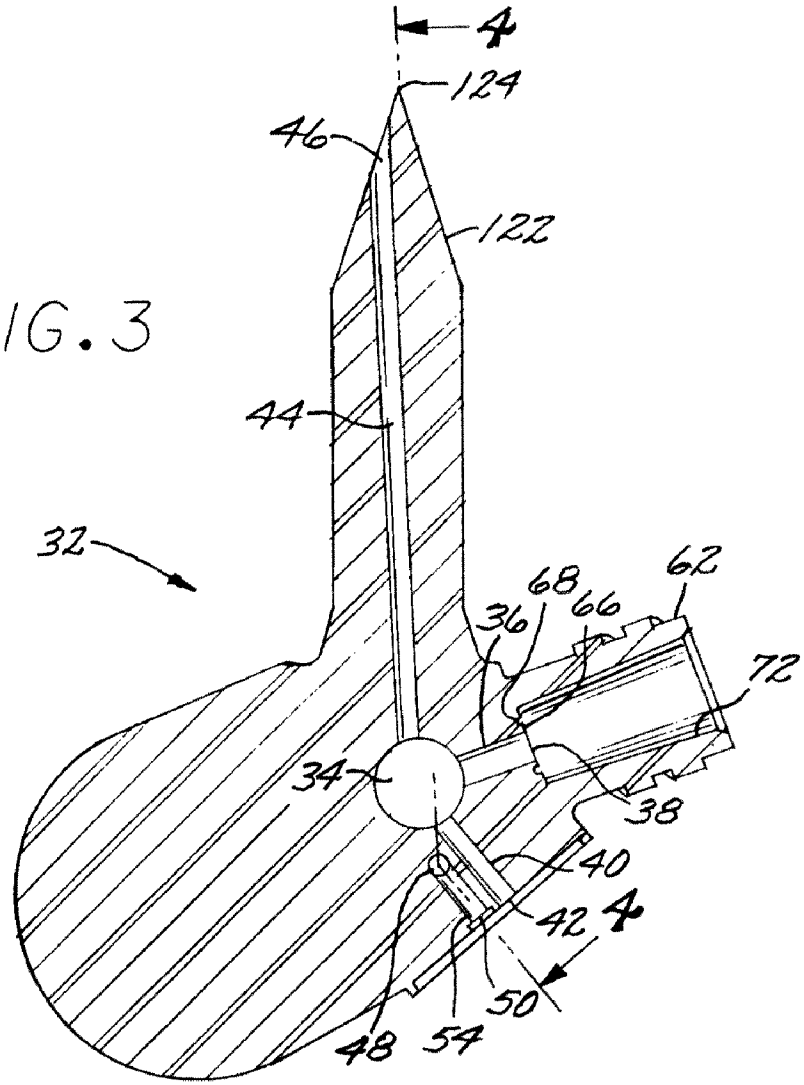
FIG. 3 is a front cross-sectional view of the body portion of the apparatus of FIG. 2, taken through the line 3-3 in FIG. 2.

FIGS. 1 and 2 illustrate one embodiment of the present apparatus 30 for reconstituting medicament. The apparatus 30 comprises a body portion 32 including an interior cavity 34 (FIGS. 2-4). In the illustrated embodiment, the cavity 34 is substantially cylindrical and extends entirely through the body portion 32, as shown in FIG. 4. Those of ordinary skill in the art will appreciate that the cavity 34 could have other shapes, and need not extend entirely through the body portion 32.

Certain components of the present apparatus 30 for reconstituting medicament are described below with reference to the body portion 32. As used herein, the term "proximal" describes a surface or portion of a component that is located nearer to the body portion 32 than other surfaces or portions of that component. Similarly, the term "distal" describes a surface or portion of a component that is located farther from the body portion 32 than other surfaces or portions of that component.

With reference to FIG. 3, which shows a front cross-sectional view of the body portion 32, a plurality of fluid lumens extends from the cavity 34 to a plurality of fluid ports at the periphery of the body portion 32. Specifically, a first fluid lumen 36 extends from the cavity 34 to a first fluid port 38, a second fluid lumen 40 extends from the cavity 34 to a second fluid port 42, and a third fluid lumen 44 extends from the cavity 34 to a third fluid port 46. In the illustrated embodiment, the fluid lumens 36, 40, 44 lie in a common plane, and are circumferentially spaced from one another around the periphery of the cavity 34, with the first lumen 36 being located between the second lumen 40 and the third lumen 44. Those of ordinary skill in the art will appreciate that the fluid lumens 36, 40, 44 need not lie in a common plane, and the illustrated locations and spacing between the lumens 36, 40, 44 is merely one example.

With continued reference to FIGS. 3 and 4, a fourth fluid lumen 48 extends through the body portion 32 from a fourth fluid port 50 to a fifth fluid port 52. A first portion 54 (FIG. 3) of the fourth lumen 48 extends from the fourth fluid port 50 parallel to the second lumen 40. The fourth lumen 48 then turns ninety-degrees and a second portion 56 (FIG. 4) extends parallel to the body portion 32 cavity 34 to the fifth fluid port 52. The second portion 56 has a first smaller diameter in a proximal region and a second larger diameter in a distal region. A junction of the proximal region and the distal region thus forms an annular shoulder 58 (FIG. 4).

Figure 5:
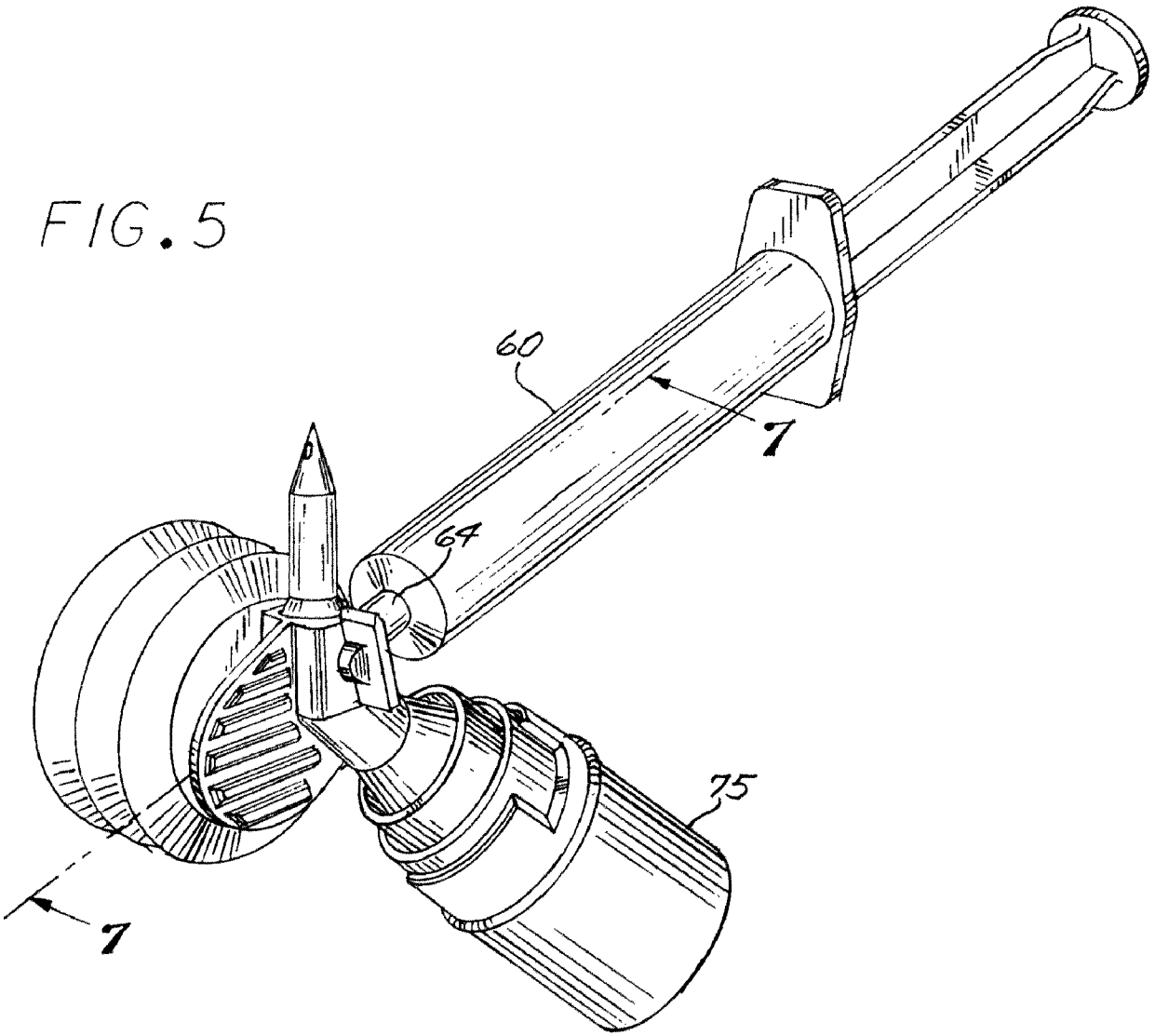
FIG. 5 is a front/left-side perspective view of the apparatus of FIG. 1 assembled with a syringe and a medicament vial.
Figure 6:
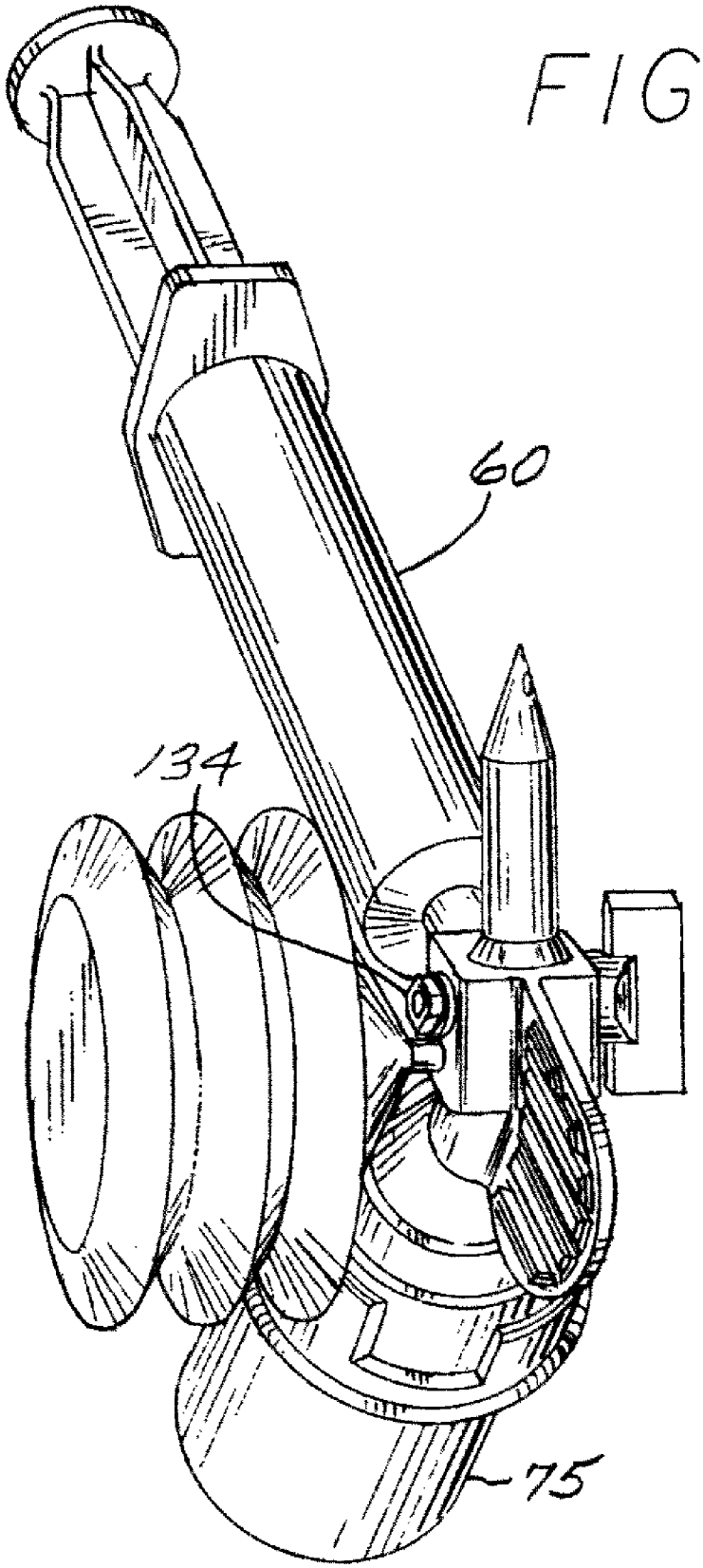
FIG. 6 is a rear/left-side perspective view of the assembly of FIG. 5.
Figure 7:
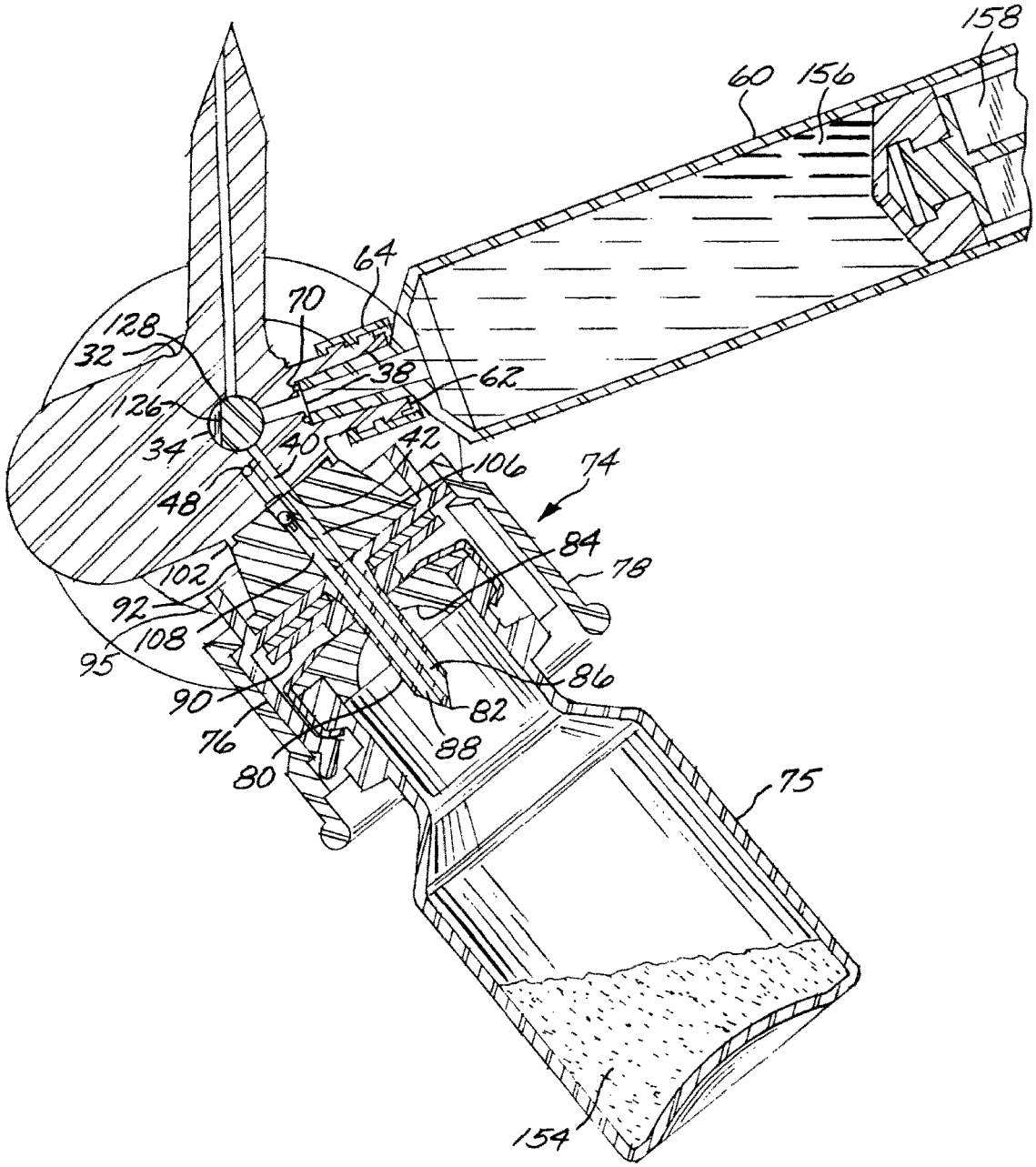
FIG. 7 is a front cross-sectional view of the assembly of FIG. 5, taken through the line 7-7 in FIG. 5.

With reference to FIGS. 5 and 6, the first fluid port 38 is configured to receive an injection/aspiration apparatus, such as a syringe 60. With reference to FIGS. 1 and 3, in the illustrated embodiment the first fluid port 38 includes an integral threaded female Luer fitting 62 extending distally from the body portion 32. The female Luer fitting 62 is configured to receive a threaded male Luer fitting 64 at the end of the syringe 60, as illustrated in FIG. 7. As described in further detail below, the syringe 60 engaged with the first fluid port 38 may be used to inject a liquid diluent 156 and withdraw a reconstituted liquid medicament. Those of ordinary skill in the art will appreciate that other types of engagement means may be used at the first fluid port 38 instead of Luer fittings.

With reference to FIG. 3, an interior diameter of the female Luer fitting 62 tapers outwardly with increasing distance from the first lumen 36. A proximal base of the female Luer fitting 62 forms an annular shoulder 66, because the interior diameter of the female Luer fitting 62 is greater at that location than the diameter of the first lumen 36. The annular shoulder 66 includes an annular recess 68 that receives a resilient O-ring seal 70 (FIG. 7). The seal 70 engages the tip of the syringe 60, as shown in FIG. 7, to reduce the likelihood that fluid may escape through any gap between the first port 38 and the syringe 60. Those of ordinary skill in the art will appreciate that other sealing mechanisms may be used in place of a resilient O-ring seal. For example, the tapered interior surface 72 (FIG. 3) of the female Luer fitting 62 may be coated with a resilient sealing material. In certain embodiments, no sealing mechanism may be provided.

With reference to FIGS. 1-3, the second fluid port 42 includes a cap adapter 74 that is configured to receive and secure a medicament vial 75, as shown in FIG. 7. The cap adapter 74 is similar, in structure and operation, to the cap adapter that is described in detail in U.S. patent application Ser. No. 12/368,791, filed Feb. 10, 2009, the disclosure of which application is incorporated herein by reference in its entirety. Briefly, with reference to FIGS. 2 and 7, the cap adapter 74 includes a vial-engaging element 76 and a locking sleeve 78 that is rotatable relative to the vial-engaging element 76. The locking sleeve 78 may provide a permanent or semi-permanent locking of the vial 75 with respect to the cap adapter 74. The cap adapter 74 further comprises a spike 80 extending distally of the body portion 32. The spike 80 includes a pointed distal tip 82 configured to puncture a stopper 84 on the vial 75 to open fluid communication between the second fluid port 42 and the interior of the vial 75, as shown in FIG. 7. In contrast to the cap adapters described in the aforementioned U.S. patent application Ser. No. 12/368,791, the illustrated cap adapter 74 includes first and second parallel, non-communicating, fluid lumens 86, 88 extending longitudinally through the spike 80. The cap adapter 74 further comprises a flexible diaphragm 90 configured to abut the exterior surface of the vial stopper 84 when the cap engages the vial 75 as shown in FIG. 7.

To secure the vial 75 to the cap adapter 74, an operator inserts the stopper-sealed end of the vial 75 into the vial-engaging element 76 until the spike 80 penetrates the stopper 84 and the diaphragm 90 abuts the exterior surface of the stopper 84. The operator then rotates the locking sleeve 78 with respect to the vial-engaging element 76 until the vial 75 is secured within the cap 74. FIG. 7 shows the configuration of the vial 75 secured within the cap 74.

With reference to FIGS. 2 and 7, the apparatus 30 further comprises a substantially frusto-conical spacer 92 having a smaller diameter proximal end abutting the body portion 32 at the location of the second fluid port 42. As best shown in FIG. 2, the spacer 92 includes a disc-shaped distal end portion 94 that abuts a proximal surface 96 of the cap adapter 74. An annular rim 95 extends proximally from the proximal surface 96 of the cap adapter 74 and is configured to receive the disc-shaped distal end portion 94 of the spacer 92 to facilitate proper positioning of the cap adapter 74 on the spacer 92. The spacer 92 further comprises a tapered riser portion 98 extending proximally from the disc-shaped portion 94 to a flat proximal surface 100 that seats against the body portion 32 (FIG. 7). The spacer 92 may be secured to the body portion 32 and the cap adapter 74 by any appropriate means, such as adhesive or welding. In the illustrated embodiment, the body portion 32 includes a raised ring 102 (FIG. 7) around the surface that receives the spacer 92, and the spacer 92 includes a mating annular shoulder 104 (FIG. 2). The ring 102 and the shoulder 104 guide the proper placement of the spacer 92 on the body portion 32. Those of ordinary skill in the art will appreciate that in certain embodiments the ring 102 and the shoulder 104 may be omitted, or their positions may be reversed.

Figure 8:
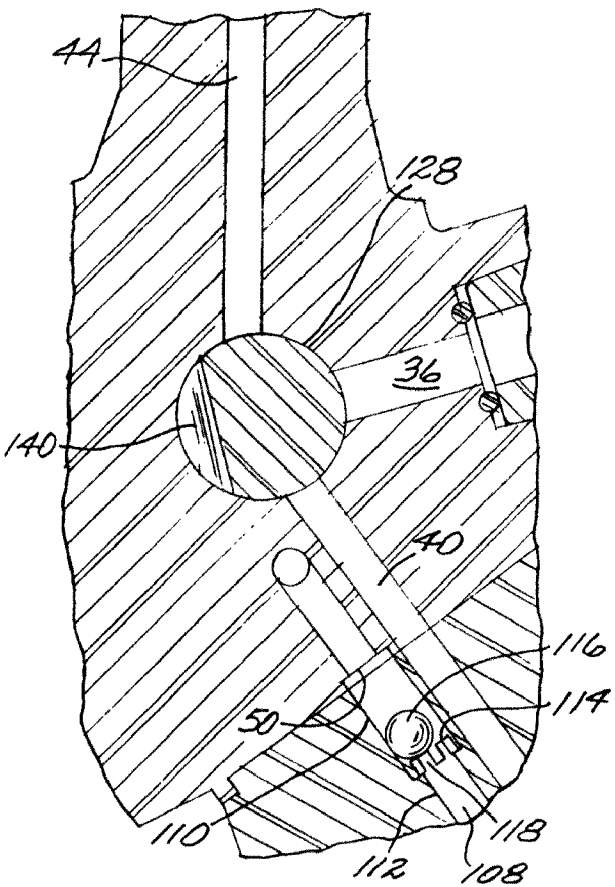
FIG. 8 is a detail view of the circled portion of FIG. 7, showing the stopcock in a first position.

With reference to FIG. 7, first and second parallel, non-communicating, fluid lumens 106, 108 extend through the spacer 92 perpendicularly to the flat surface 100. The first spacer lumen 106 aligns with the first spike lumen 86 and the second body portion lumen 40. The second spacer lumen 108 aligns with the second spike lumen 88 and the fourth body portion lumen 48. With reference to FIG. 8, the second spacer lumen 108 includes a wider diameter proximal portion 110 and a narrower diameter distal portion 112. The junction of the proximal and distal portions forms an annular shoulder that includes a plurality of proximally extending tabs 114. A ball 116 resides within the proximal portion 110 and is freely movable between the tabs 114 and the fourth fluid port 50. The diameter of the ball 116 is slightly smaller than the diameter of the proximal portion 110 of the second spacer lumen 108, but larger than the diameter of the distal portion 112 thereof. The ball 116 thus cannot pass into the distal portion 112. However, when the ball 116 rests on the tabs 114, fluid can pass freely around the ball 116 in either direction by flowing through gaps 118 between adjacent tabs 114.

With continued reference to FIG. 8, a diameter of the body portion fourth lumen 48 is smaller than a diameter of the spacer second lumen proximal portion 110, except for a short length 120 (FIG. 9) at the distal end of the body portion fourth lumen 48 where the diameter matches that of the spacer second lumen proximal portion 110. The distal end of the body portion fourth lumen 48 and the ball 116 form a check valve that prevents fluid flow through the body portion fourth lumen 48 from the fourth fluid port 50 toward the fifth fluid port 52 under certain circumstances described below.

With reference to FIGS. 1-3, the body portion 32 further comprises an integral spike 122 extending outwardly (distally) from the body portion 32. The third fluid lumen 44 extends through the spike from the cavity 34 to the third fluid port 46, as shown in FIG. 3. The spike 122 includes a pointed distal tip 124 that is configured to puncture an intravenous (IV) fluid bag, as described in further detail below.

With reference to FIGS. 1, 2 and 8, the body portion interior cavity 34 receives a stopcock 126 that regulates fluid communication between the first, second and third fluid lumens 36, 40, 44. With particular reference to FIGS. 1 and 2, the stopcock 126 includes a cylindrical post 128 that is snugly but rotatably received in the cavity 34. A first end of the stopcock 126 includes a transverse planar portion 130 that resides exterior to the body portion 32. The transverse planar portion 130 provides a surface for gripping and rotating the stopcock 126 relative to the cavity 34. An opposite end of the stopcock 126 includes a reduced diameter portion 132 having threads for receiving a nut 134 (FIGS. 2 and 6) to secure the stopcock 126 with respect to the body portion 32. Those of ordinary skill in the art will appreciate that other securing means could be used in place of a nut. For example, a rivet could replace the nut, or the end of the post 128 opposite the transverse planar portion 130 could include cantilevered flexible arms that snap outward to grip the body portion 32 when the stopcock 126 is fully inserted within the cavity 34. In embodiments not including a nut, the post 128 might not include the reduced diameter portion or any threads. With reference to FIG. 4, opposite ends of the cavity 34 include chamfers 136 that receive O-rings 138 (FIG. 2). The O-rings 138 seal the junctions between the chamfers 136 and the stopcock 126 and nut 134. In certain embodiments, the O-rings 138 may be omitted. For example, the fit between the cavity 34 and the stopcock 126 may be very snug so that the interface between these components resists fluid leakage.

Figure 10:
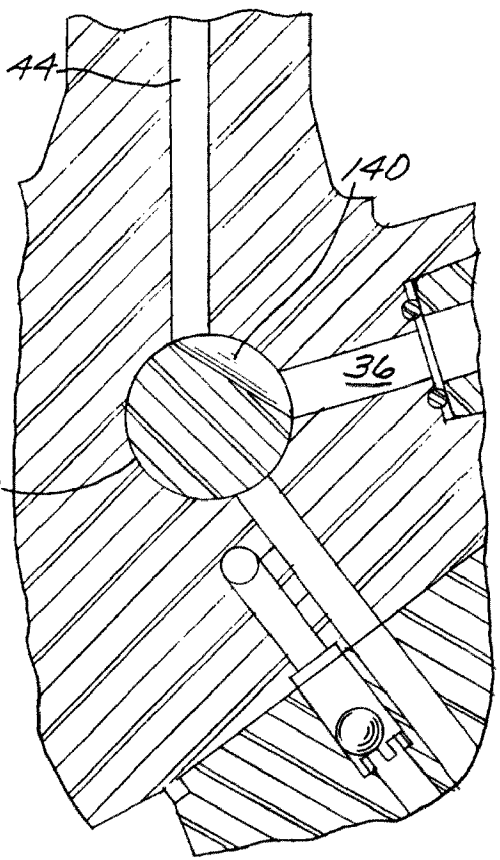
FIG. 10 is a detail view of the circled portion of FIG. 7, showing the stopcock in a third position.
Figure 9:
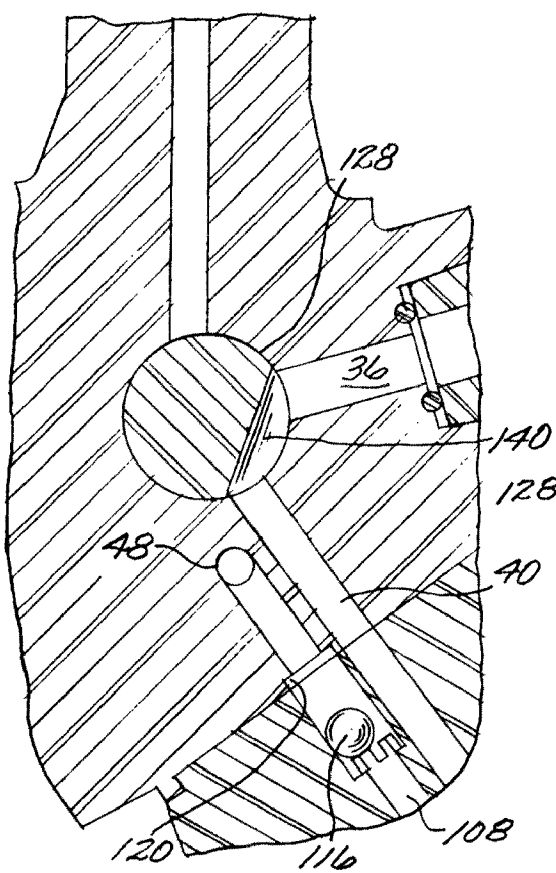
FIG. 9 is a detail view of the circled portion of FIG. 7, showing the stopcock in a second position.

With reference to FIGS. 2 and 8-10, the stopcock post 128 includes an indentation 140 in its sidewall. The indentation 140 is located at a position along the length of the stopcock post 128 so that it may be selectively aligned with each of the first, second and third fluid lumens 36, 40, 44 to regulate fluid flow between the lumens. Three rotational positions of the stopcock 126 are illustrated in FIGS. 8-10. In FIG. 8, the stopcock 126 is in an "OFF" position in which the indentation 140 faces away from all of the fluid lumens 36, 40, 44. In the "OFF" position the cylindrical sidewall of the post 128 blocks fluid flow between all of the lumens 36, 40, 44. Those of ordinary skill in the art will appreciate that alternative "OFF" positions are defined at rotational positions in which the indentation 140 faces one and only one of the fluid lumens 36, 40, 44. In FIG. 9, the indentation 140 faces the first and second fluid lumens 36, 40. The indentation 140 thus creates a fluid passage so that fluid may flow freely between the first and second fluid lumens 36, 40. Similarly, in FIG. 10 the indentation 140 faces the proximal ends of the first and third fluid lumens 36, 44, thereby opening fluid flow between those lumens. Fluid flow between lumens is described in further detail below with reference to a method of using the apparatus 30.

With reference to FIGS. 1, 2 and 4, the apparatus 30 further comprises an enclosed expansible air chamber 142 operatively connected to the fifth fluid port 52. In the illustrated embodiment, the expansible air chamber 142 is provided by a bellows. Those of ordinary skill in the art will appreciate that the expansible air chamber 142 could be any appropriate device or functional equivalent to a bellows, such as, for example, a balloon. The expansible air chamber or bellows 142 includes a protruding nipple 146 (FIG. 2) that is received within the larger diameter portion 148 of the fourth fluid lumen 48 at the fifth fluid port 52. The nipple 146 and the fifth port 52 preferably engage one another in a fluid-tight friction fit. Adhesive and/or sealant may be applied to the junction between the nipple 146 and the fifth port 52 to reduce the likelihood of leaking. During operation of the apparatus 30, which is described in detail below, the bellows 142 receives air from the medicament vial 75 through the fourth fluid lumen 48 and returns the air to the vial 75 in a subsequent operational step.

With reference to FIGS. 1 and 2, the body portion 32 may optionally include a gripping flange 150 configured to aid an operator's ability to hold and manipulate the apparatus 30. The flange 150, if present, may be any suitable shape, such as a substantially as a half-oval plate, and it extends from the body portion 32 opposite the female Luer connector 62. An operator may grip the flange 150 between his or her thumb and forefinger, for example. A plane defined by the flange 150 coincides with or is parallel to a longitudinal axis of the spike 122. The illustrated flange 150 includes optional surface ridges 152 to enhance gripping.

With reference to FIGS. 5, 7-10 and 13-16, one method of using the apparatus 30 comprises engaging a syringe 60 with the first port 38 and a medicament vial 75 with the second port 42 as shown in FIGS. 5 and 7. With reference to FIG. 7, the syringe 60 is connected by positioning its male Luer fitting 64 in contact with the female Luer fitting 62 of the first port 38 and then rotating the syringe 60 to engage the threads of the two fittings. The syringe 60 is preferably advanced until its tip firmly engages the O-ring 70 to establish a fluid-tight seal. The method of connecting the vial 75 to the second port 42 is described in detail above.

With reference to FIG. 7, the vial 75 contains medicament 154, which may be in the form of a powder or a concentrated liquid. The syringe 60 contains a liquid constituent or diluent 156, which commonly is water or saline, but could be any liquid suitable for reconstituting the medicament 154. While connecting the vial 75 and syringe 60, the stopcock post 128 is preferably in the "OFF" position (FIGS. 7 and 8) to reduce the likelihood of unwanted fluid flow through the cavity 34. Also, it is preferable to connect the syringe 60 first and the vial 75 second so that the first port 38 is sealed prior to the vial stopper 84 being punctured. In the event that the stopcock 126 is in a position to enable fluid flow between the first and second lumens 36, 40, a sealed first port 38 makes it unlikely that medicament 154 within the vial 75 will leak or form an aerosol to the ambient environment by traveling out the first port 38.

Once the syringe 60 and the vial 75 are connected, the stopcock post 128 is rotated to the position shown in FIG. 9 to open fluid communication between the first and second fluid lumens 36, 40. The syringe plunger 158 (FIG. 7) is then depressed to inject the diluent 156 into the vial 75 through the first and second body portion lumens 36, 40, through the spacer first lumen 106, and through the first spike lumen 86. As the diluent 156 enters the vial 75, it displaces air from the vial 75. Thus, during this step it is advantageous to have the assembly oriented such that the vial 75 is substantially right-side-up, similar to the orientation shown in FIG. 7. In this orientation, as the diluent 156 displaces the air in the vial 75, the air can flow upward through the second spike lumen 88, through the second spacer lumen 108, through the body portion fourth lumen 48 and into the bellows 142. Gravity keeps the ball 116 in the check valve away from the fourth fluid port 50 so that air can flow past the ball 116. The air exiting the vial 75 equalizes the pressure in the vial 75 and the syringe 60, lessening the force that the operator must use to depress the plunger 158.

When all of the diluent 156 has been injected, the operator may mix the solution in the vial 75 by swirling, for example. After mixing, the solution in the vial 75 is reconstituted medicament 160 (FIG. 13). To withdraw the reconstituted medicament 160 from the vial 75, the operator inverts the assembly as shown in FIG. 13 so that the vial stopper 84 points generally downward. In this orientation, gravity pulls the ball 116 against the fourth fluid port 50, as shown in FIG. 13 and in the detail view of FIG. 14. The ball 116 forms a seal against the fourth fluid port 50 that resists passage of the reconstituted medicament 160 into the bellows 142. This orientation also draws the reconstituted medicament 160 down to the cap adapter spike 80. When the operator draws back the syringe plunger 158, the vacuum created inside the syringe 60 sucks the reconstituted medicament 160 out of the vial 75 through the first spike lumen 36, through the first spacer lumen 106, and then through the first and second body portion lumens 36, 40. The operator continues drawing back the plunger 158 until the desired amount of reconstituted medicament 160 has been drawn into the syringe 60. As the reconstituted medicament 160 exits the vial 75, the vacuum created inside the vial 75 sucks air out of the bellows 142 and into the vial 75 through the body portion fourth lumen 40, through the second spacer lumen 108, and through the second spike lumen 88. The air flowing out of the bellows 142 forces the ball 116 to rise off the fourth fluid port 50 (FIG. 14), breaking the seal so that the air can pass. The outrushing air also pushes against the reconstituted medicament 160, resisting its passage through the fourth fluid port 50 and into the bellows 142. The air entering the vial 75 equalizes the pressure in the vial 75 and the syringe 60, lessening the force that the operator must use to draw back the plunger 158.

Figure 15:
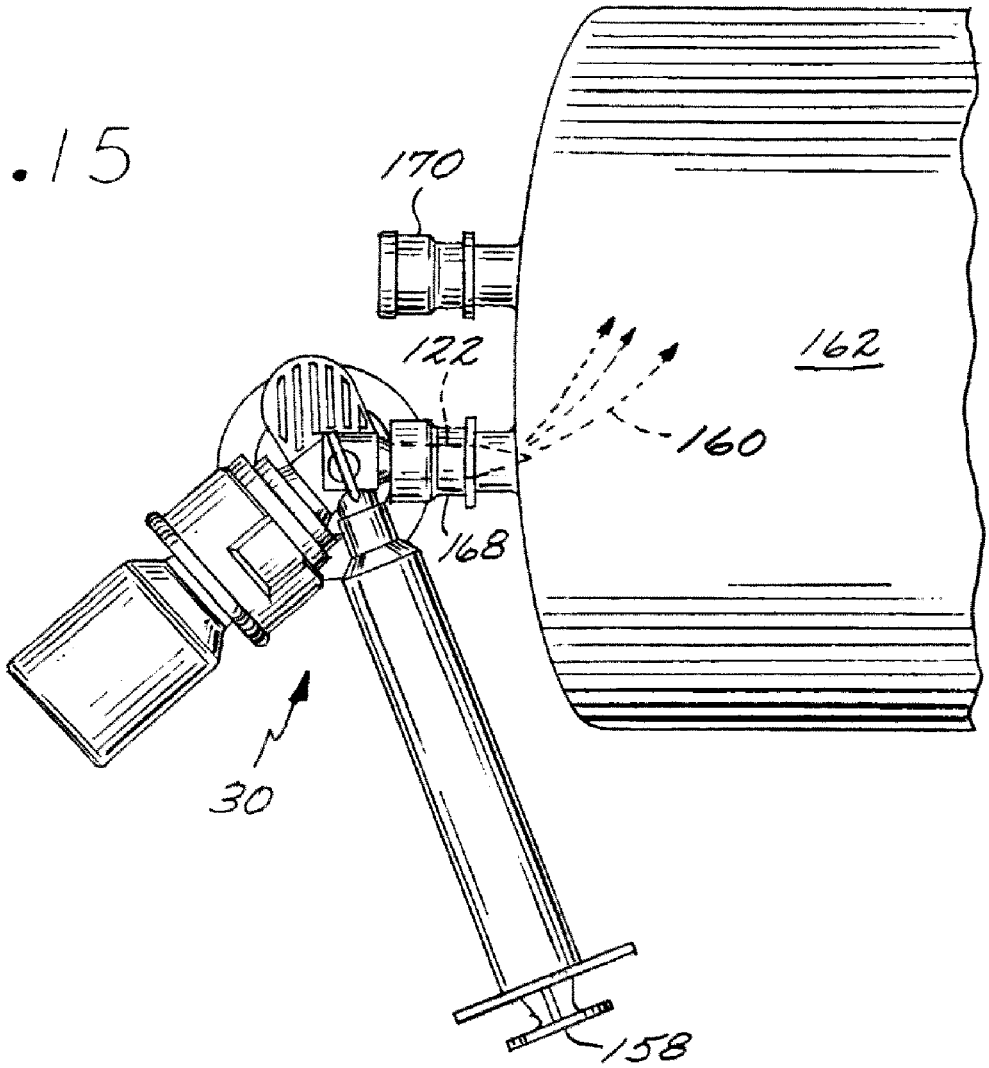
FIG. 15 is a front elevation view of the apparatus of FIG. 5 puncturing a first port in an intravenous (IV) fluid bag.

With the desired amount of reconstituted medicament 160 contained in the syringe 60, the operator next punctures an IV fluid bag 162 with the spike 122, as shown in FIG. 15. The IV 162 bag may contain saline, and/or other solutes. The spike 122 penetrates a first resilient seal portion 168 in the bag 162. The resilient seal portion 168 is configured to seal around the penetrating spike 122 to resist leaking of fluid from the bag 162. The operator next turns the stopcock post 128 to the position of FIG. 10 to open fluid communication between the first and third lumens 36, 44. When fluid communication is established, the operator depresses the plunger 158 to inject the reconstituted medicament 160 into the IV bag 162 as shown in FIG. 15. The operator then mixes the reconstituted medicament 160 with the saline in the bag 162 by manipulating the bag 162 in an appropriate fashion.

Figure 16:
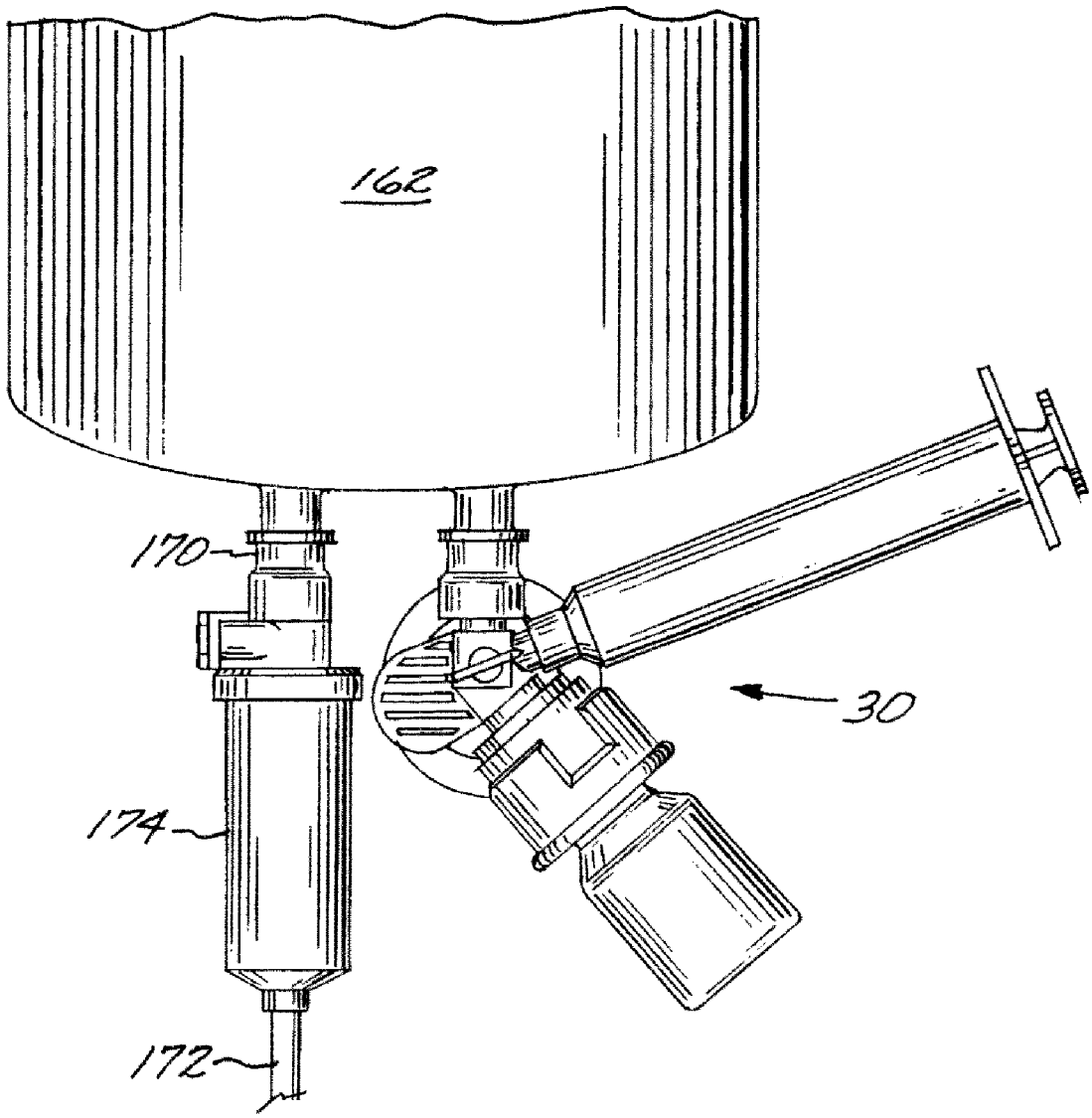
FIG. 16 is a front elevation view of the assembly of FIG. 15 with a drip chamber puncturing a second port in the IV fluid bag.

As shown in FIG. 15, the bag 162 further includes a second resilient seal portion 170 spaced from the first resilient seal 168. After mixing the solution in the IV bag 162, the operator punctures the second resilient seal portion 170 with a spike (not shown) at a first end of an IV line 172, as shown in FIG. 16. The IV line 172 may include a drip chamber 174 as shown to regulate the flow of liquid out of the bag 162. Alternatively, a drip chamber 174 may be included in another IV line (not shown) into which the IV line 172 feeds. In yet another alternative the drip chamber 174 may be omitted. The opposite end (not shown) of the IV line 172 may include a needle (not shown) that punctures a patient's vein. Alternatively, the opposite end of the IV line 172 may feed into another IV line (not shown) that feeds into the patient. The IV solution, which contains the properly reconstituted and diluted medicament 160, is then fed to the patient through the IV line 172.

As those of ordinary skill in the art will appreciate, the steps in the method described above may be performed in a different order than as described. For example, in the order described above the operator punctures the first resilient seal portion 168 in the IV fluid bag 162 with the spike 122, then injects the reconstituted medicament 160 into the IV bag 162, then mixes the reconstituted medicament 160 with the saline in the bag 162, and then punctures the second resilient seal portion 170 with a spike (not shown) at a first end of an IV line 172. In an alternative embodiment, the operator may puncture the second resilient seal portion 170 with a spike (not shown) at a first end of an IV line 172, then puncture the first resilient seal portion 168 in the IV fluid bag 162 with the spike 122, then inject the reconstituted medicament 160 into the IV bag 162, and then mix the reconstituted medicament 160 with the saline in the bag 162.

Figure 11:
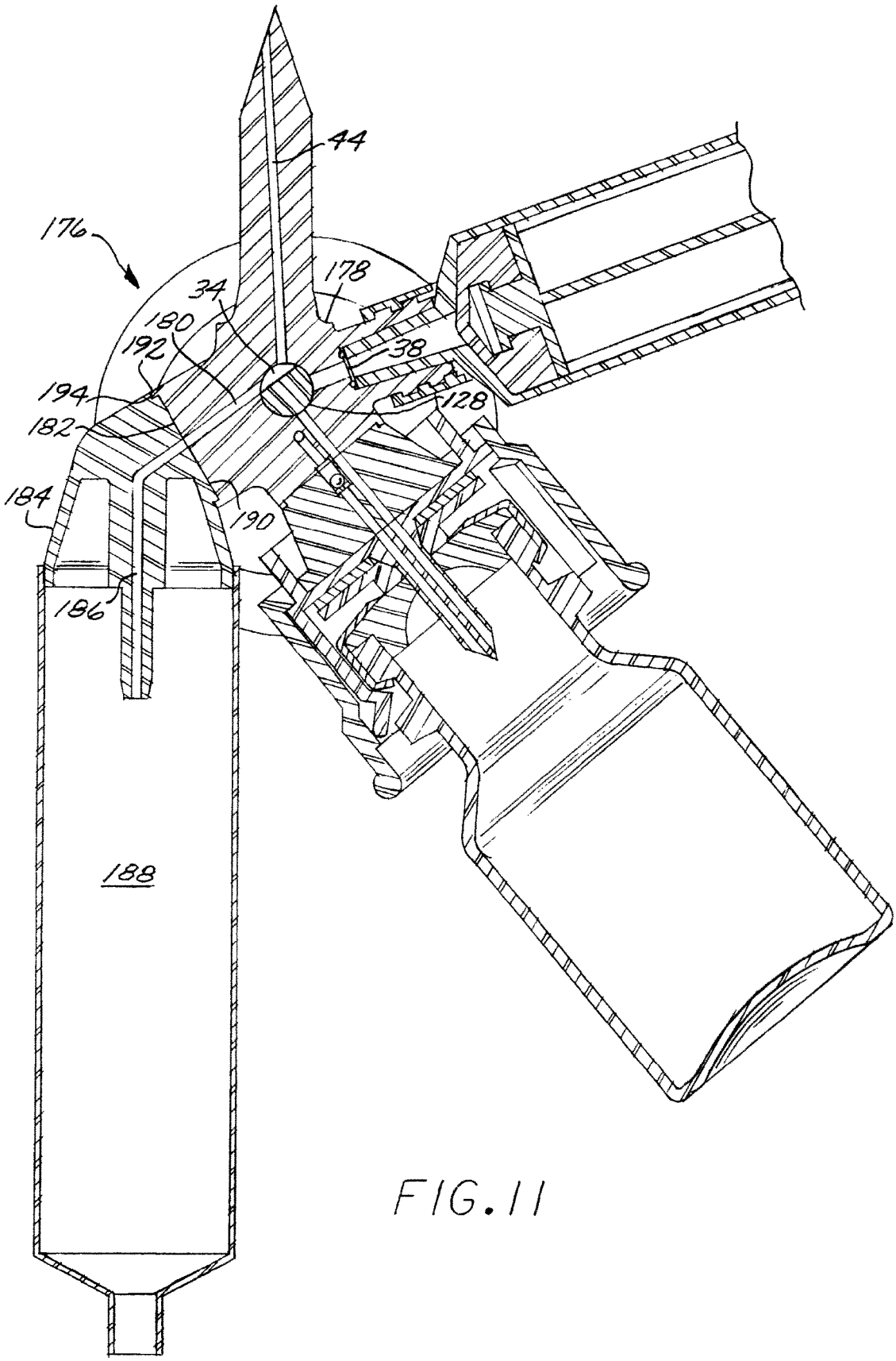
FIG. 11 is a front cross-sectional view of another embodiment of the present apparatus for reconstituting medicament including an integrated drip chamber.

FIG. 11 illustrates an alternative embodiment of the present apparatus 176 for reconstituting medicament. The apparatus 176 does not include a gripping flange. Instead, in the area where the gripping flange 150 is located in the previous embodiment, the body portion 178 includes a fifth fluid lumen 180 extending from the interior cavity 34. The fifth fluid lumen 180 extends to a distal surface 182 of the body portion 178 opposite the first port 38. Abutting the distal surface 182 is a drip chamber fitting 184. The fitting 184 includes a lumen 186 that aligns with the fifth fluid lumen 180 for passage of fluid into a drip chamber 188. Once in the drip chamber 188, fluid drains into an IV line (not shown) at the bottom of the drip chamber 188. The fitting 184 includes an oblique surface 190 that abuts and is secured to the distal surface 182 by any appropriate means, such as adhesive or welding. In the illustrated embodiment, the distal surface 182 includes a raised ring 192 around the surface that receives the oblique surface 190, and the oblique surface 190 includes a mating annular shoulder 194. The ring 192 and the shoulder 194 guide the proper placement of the oblique surface 190 on the body portion 178 so that the fifth fluid lumen 180 properly aligns with the lumen 186 in the drip chamber fitting 184. Those of ordinary skill in the art will appreciate that in certain embodiments the ring 192 and the shoulder 194 may be omitted, or their positions may be reversed.

Figure 17:
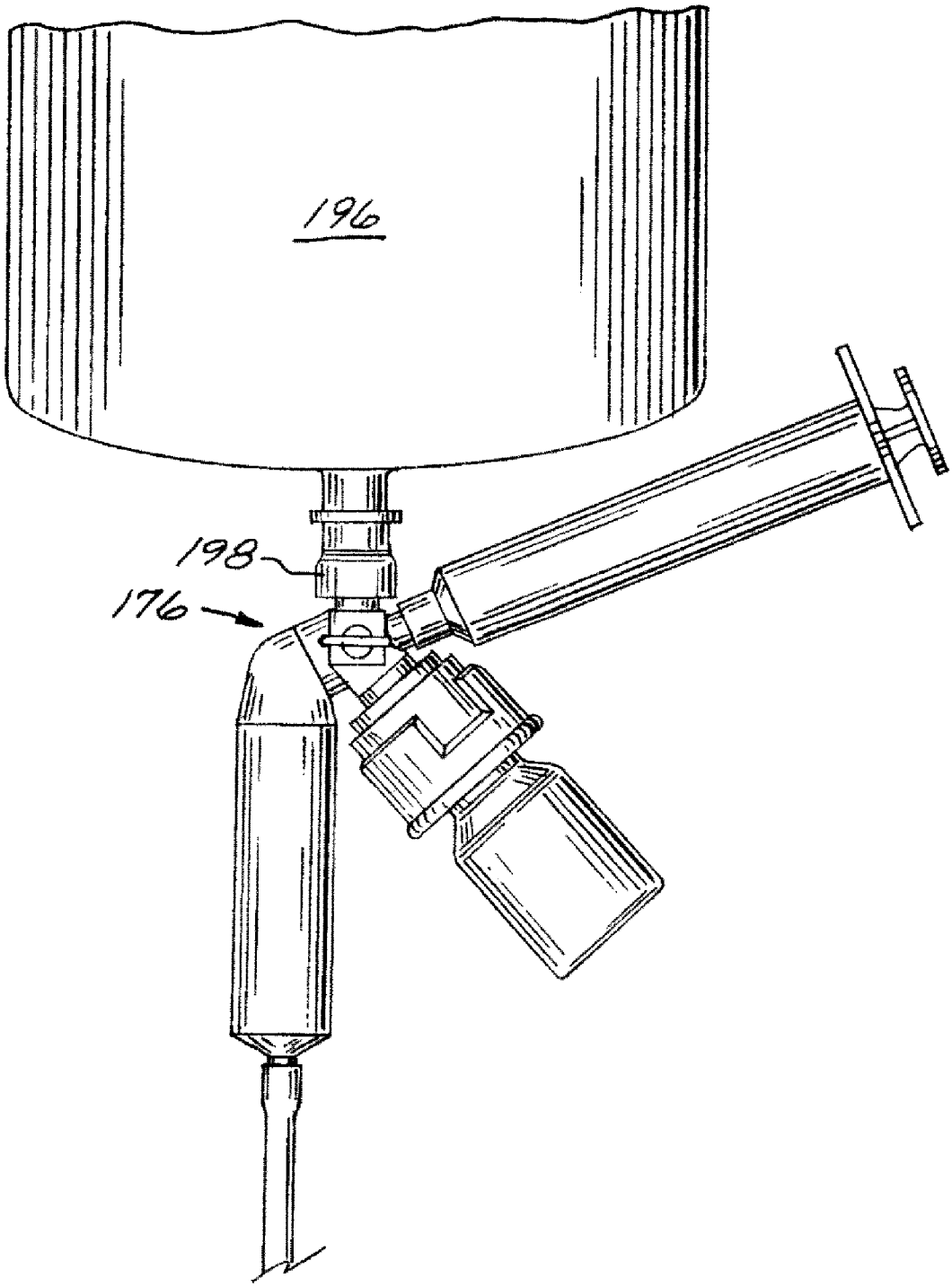
FIG. 17 is a front elevation view of the apparatus of FIG. 11 puncturing an IV fluid bag.

The apparatus 176 of FIG. 11 is adapted for use with an IV bag 196 having only one resilient seal portion 198, as shown in FIG. 17. To use the apparatus 176, the operator follows the same procedure above except that after spiking the single-port IV bag 196 (FIG. 17) the operator turns the stopcock post 128 to a fourth position shown in FIG. 11. In this position, fluid communication is open between the third and fifth lumens 44, 180 so that the reconstituted and diluted medicament can drain from the IV bag 196 through the third and fifth lumens 44, 180, through the lumen 186 in the drip chamber fitting 184, and into the drip chamber 188. From the drip chamber 188 the fluid passes into an IV line (not shown) and eventually into the patient in the manner described above.

FIG. 12 illustrates another alternative embodiment of the present apparatus 200 for reconstituting medicament. The apparatus 200 of FIG. 12 is similar to the apparatus 176 of FIG. 11, except that the spike 202 includes a sixth lumen 204 in addition to the third lumen 44. Operation of the apparatus 200 of FIG. 12 is similar to operation of the apparatus 176 of FIG. 11, except that to drain the reconstituted and diluted medicament from the IV bag the stopcock post 128 is rotated to the position shown in FIG. 12 so that it opens fluid communication between the fifth and sixth lumens 180, 204. In this position of the stopcock 126, the reconstituted and diluted medicament drains from the IV bag through the fifth and sixth lumens 180, 204, through the lumen 186 in the drip chamber fitting 184, and into the drip chamber 188. From the drip chamber 188 the fluid passes into an IV line (not shown) and eventually into the patient in the maimer described above.

Figure 18:
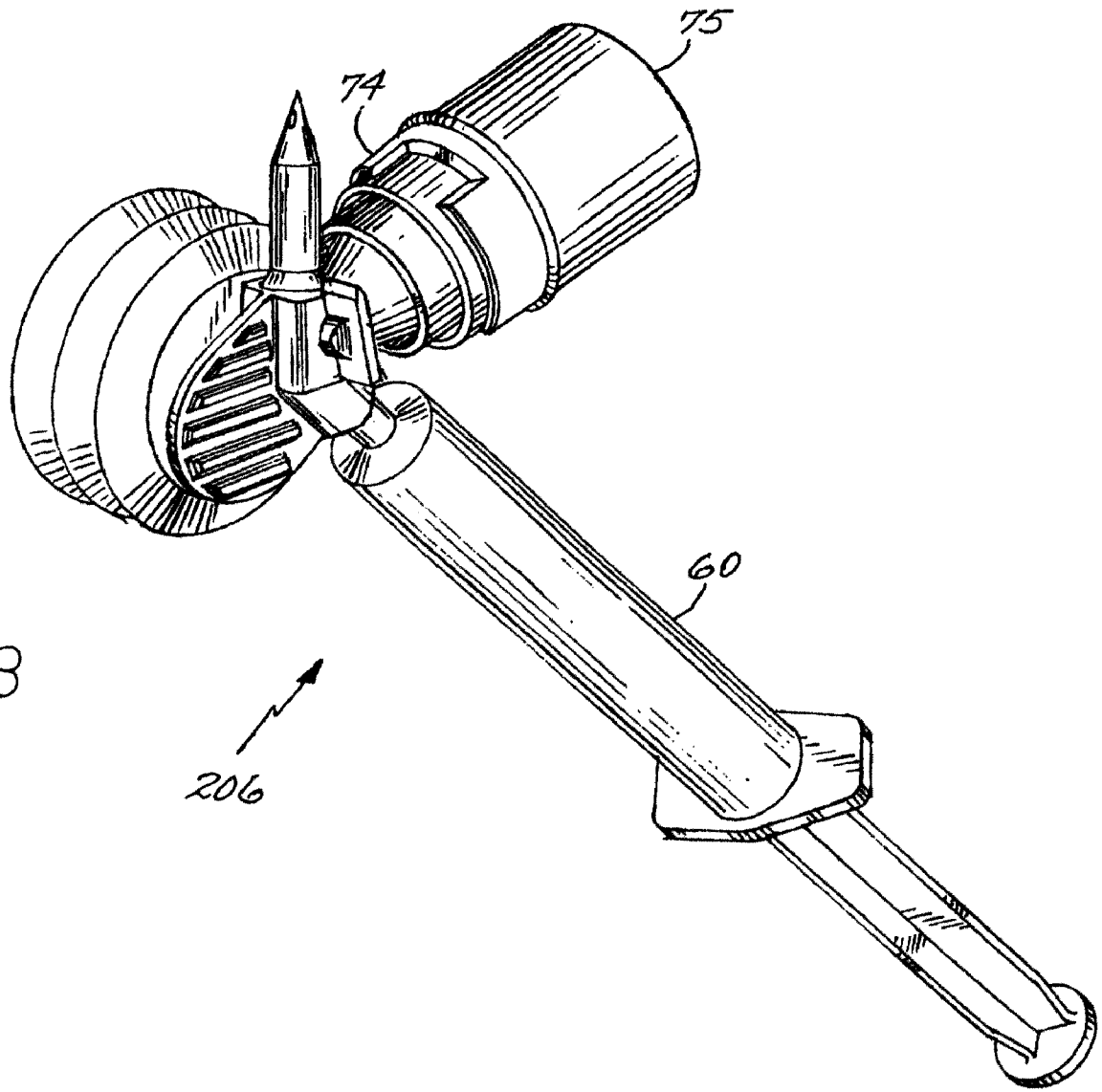
FIG. 18 is a front/side perspective view of another embodiment of the present apparatus for reconstituting medicament assembled with a syringe and a medicament vial in a reverse configuration compared to the assembly of FIG. 5.

FIG. 18 illustrates another alternative embodiment of the present apparatus 206 for reconstituting medicament. The structure and operation of the apparatus 206 of FIG. 18 is similar to that of the apparatus 30 of FIG. 1, except that the locations of the female Luer fitting (not shown) and the cap adapter 74 are reversed. The locations of the syringe 60 and the vial 75 are thus also reversed.

Figure 19:
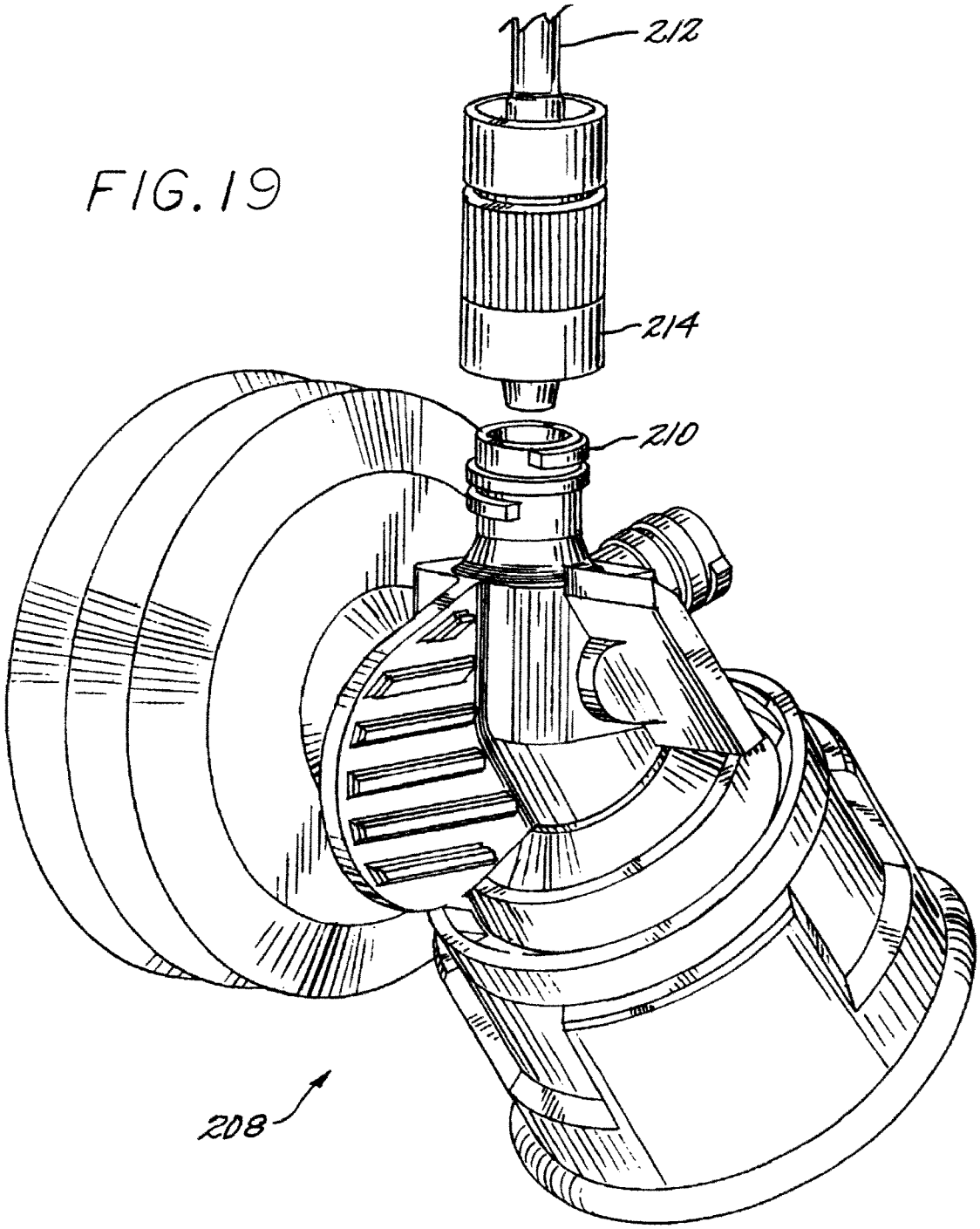
FIG. 19 is a front/side perspective view of another embodiment of the present apparatus for reconstituting medicament including a Luer fitting and an exploded intravenous line.

FIG. 19 illustrates another alternative embodiment of the present apparatus 208 for reconstituting medicament. The structure and operation of the apparatus 208 of FIG. 19 is similar to that of the apparatus 30 of FIG. 1, except that the spike 122 is replaced with a female Luer fitting 210. The female Luer fitting 210 is configured to be secured to IV tubing 212, or any other apparatus, having a male Luer fitting 214. Reconstituted liquid medicament can be displaced through the female Luer fitting 210 to travel anywhere desired, such as through the IV tubing 212 to merge with liquid flowing through other IV tubing (not shown).

Embodiments of the present apparatus 30, 176, 200, 206, 208 for reconstituting medicament advantageously comprise a closed system. Concentrated medicament 154 remains in the vial 75 until diluted or re-hydrated with liquid diluent 156 injected by the syringe 60. The reconstituted medicament 160 passes from the vial 75 into the syringe 60 through the body portion 32. The reconstituted medicament 160 then passes from the syringe 60 into an IV bag, again, through the body portion 32. The reconstituted medicament then passes from the IV bag through tubing and into the patient. At no time is the medicament exposed to the ambient environment. The various seals described above resist escape of the medicament from the closed system. The likelihood is thus substantially reduced that the medicament, which can be highly toxic, especially before being diluted, will come into contact with or be inhaled by anyone in the vicinity of the apparatus. When all of the reconstituted medicament has been administered to the patient, the entire assembly, including the syringe, the vial and the IV bag and tubing, can be properly disposed of without disconnecting any of the components. The system thus remains entirely closed from start to disposal.

The above description presents the best mode contemplated for carrying out the present apparatus and methods for reconstituting medicament, and of the manner and process of making and using it, in such full, clear, concise, and exact terms as to enable any person skilled in the art to which it pertains to make and use this apparatus and practice these methods. This apparatus and these methods are, however, susceptible to modifications and alternate constructions from that discussed above that are fully equivalent. Consequently, this apparatus and these methods are not limited to the particular embodiments disclosed. On the contrary, this apparatus and these methods cover all modifications and alternate constructions coming within the spirit and scope of the apparatus and methods as generally expressed by the following claims, which particularly point out and distinctly claim the subject matter of the apparatus and methods.

What is claimed is:

1. Apparatus for reconstituting a medicament in a vial with a liquid from a syringe, the apparatus comprising:

a body portion defining an interior cavity and having first, second, and third fluid ports communicating with the interior cavity, the body portion further defining a body lumen extending through the body portion without intersecting the interior cavity, and fourth and fifth fluid ports communicating with each other bidirectionally through the body lumen;

a fitting on the first fluid port configured to receive a syringe;

a fluid regulating element located within the interior cavity and configured to be selectively movable among (a) a first position in which fluid communication through the interior cavity is blocked, (b) a second position in which fluid communication is open through the interior cavity between the first and second fluid ports, and (c) a third position in which fluid communication is open through the interior cavity between the first and third fluid ports;

an adapter assembly fixed to the body portion and configured for removable attachment of a medicament vial so that the vial is in fluid communication with the second fluid port and the fourth fluid port; and an expansible air chamber operatively connected to the fifth fluid port so as to allow the bidirectional passage of air through the body lumen between the air chamber and the fourth fluid port.

2. The apparatus of claim 1, wherein the first fluid port comprises a Luer fitting.

3. The apparatus of claim 1, wherein the body portion includes a spike configured to puncture an intravenous fluid bag, and wherein the spike includes the third fluid port.

4. The apparatus of claim 1, wherein the adapter assembly includes a first spacer lumen communicating with the second fluid port and a second spacer lumen communicating with the fourth fluid port.

5. The apparatus of claim 4, wherein the adapter assembly is configured to receive a medicament vial having a stopper, wherein the adapter assembly includes an adapter spike element configured to breach the stopper when a vial is attached to the body portion, and wherein the first and second spacer lumens extend through the adapter spike element.

6. The apparatus of claim 1, further comprising a check valve that allows free bidirectional airflow past the valve and through the body lumen.

7. The apparatus of claim 6, wherein the check valve prevents liquid flow past the valve and through the body lumen when the apparatus is oriented in a first orientation.

8. A method for reconstituting a medicament contained in a vial with a liquid from a syringe, the method comprising:

(a) using a medicament reconstituting apparatus, comprising:

a device body defining an interior cavity; first, second, and third fluid ports communicating with the interior cavity; a body lumen extending through the body without intersecting the interior cavity; and fourth and fifth fluid ports communicating with each other through the body lumen;

a fluid regulating element located within the interior cavity and configured to be selectively movable among (i) a first position in which fluid communication through the interior cavity is blocked, (ii) a second position in which fluid communication is open through the interior cavity between the first and second fluid ports, and (iii) a third position in which fluid communication is open through the interior cavity between the first and third fluid ports; and an expansible air chamber operatively connected to the fifth fluid port so as to allow the bidirectional passage of air through the body lumen between the air chamber and fourth fluid port;

(b) with the fluid regulating element in the first position, engaging the syringe containing the liquid with the device body so as to be in fluid communication with the first fluid port, and engaging the vial with the device body so as to be in fluid communication with the second and fourth fluid ports;

(c) moving the fluid regulating element to the second position;

(d) injecting the liquid from the syringe into the vial through the first fluid port, the interior cavity, and the second fluid port to create a reconstituted medicament;

(e) withdrawing the reconstituted medicament from the vial into the syringe through the second fluid port, the interior cavity, and the first fluid port;

(f) moving the fluid regulating element to the third position; and (g) expelling the reconstituted medicament from the syringe out of the device body through the first fluid port, the interior cavity, and the third fluid port.

9. The method of claim 8, wherein the vial contains a volume of air, and wherein air is displaced from the vial into the expansible air chamber through the fourth fluid port, the body lumen, and the fifth fluid port during the step of injecting the liquid from the syringe into the vial.

10. The method of claim 9, wherein air is transferred from the expansible air chamber into the vial through the fifth fluid port, the body lumen, and the fourth fluid port during the step of withdrawing the reconstituted medicament from the vial into the syringe.

11. The method of claim 8, wherein, prior to the step of withdrawing the reconstituted medicament from the vial into the syringe, the apparatus is inverted.

12. The method of claim 8, wherein the vial has a stopper, wherein the device body includes an adapter assembly through which the second and fourth fluid ports communicate with the interior cavity, and wherein the step of engaging the vial with the device body includes the step of breaching the stopper to establish fluid communication between the interior of the vial and the interior cavity through the second and fourth fluid ports.

13. The method of claim 8, wherein the device body is configured for attachment of an IV line thereto so as to be in fluid communication with the third fluid port, and wherein the step of expelling includes the introduction of the reconstituted medicament into the IV line through the third fluid port.

14. Apparatus for reconstituting a medicament in a vial with a liquid from a syringe, the apparatus comprising:

a body portion defining an interior cavity and having first, second, and third fluid ports communicating with the interior cavity, the body portion further defining a body lumen extending through the body portion so as to be fluidly isolated from the interior cavity, and fourth and fifth fluid ports communicating with each other bidirectionally through the body lumen, wherein the first, second, third and fourth fluid ports all lie in the same plane;

a fitting on the first fluid port configured to receive a syringe;

a fluid regulating element located within the interior cavity and configured to be selectively movable among (a) a first position in which fluid communication through the interior cavity is blocked, (b) a second position in which fluid communication is open through the interior cavity between the first and second fluid ports, and (c) a third position in which fluid communication is open through the interior cavity between the first and third fluid ports;

an adapter assembly fixed to the body portion and configured for removable attachment of a medicament vial so that the vial is in fluid communication with the second fluid port and the fourth fluid port; and an expansible air chamber operatively connected to the fifth fluid port so as to allow the bidirectional passage of air through the body lumen between the air chamber and the fourth fluid port.

15. The apparatus of claim 14, wherein the body portion includes a spike configured to puncture an intravenous fluid bag, and wherein the spike includes the third fluid port.

16. The apparatus of claim 14, wherein the adapter assembly includes a first spacer lumen communicating with the second fluid port and a second spacer lumen communicating with the fourth fluid port.

17. The apparatus of claim 16, wherein the adapter assembly is configured to receive a medicament vial having a stopper, wherein the adapter assembly includes an adapter spike element configured to breach the stopper when a vial is attached to the body portion, and wherein the first and second spacer lumens extend through the adapter spike element.

18. The apparatus of claim 14, further comprising a check valve that allows free bidirectional airflow past the valve and through the body lumen.

19. The apparatus of claim 18, wherein the check valve prevents liquid flow past the valve and through the body lumen when the apparatus is oriented in a first orientation.

20. A method for reconstituting a medicament contained in a vial with a liquid from a syringe, the method comprising:

(a) using a medicament reconstituting apparatus, comprising:

a device body defining an interior cavity; first, second, and third fluid ports communicating with the interior cavity; a body lumen extending through the body so as to be isolated from the interior cavity; and fourth and fifth fluid ports communicating with each other through the body lumen; wherein the first, second, third and fourth fluid ports all lie in the same plane;

a fluid regulating element located within the interior cavity and configured to be selectively movable among (i) a first position in which fluid communication through the interior cavity is blocked, (ii) a second position in which fluid communication is open through the interior cavity between the first and second fluid ports, and (iii) a third position in which fluid communication is open through the interior cavity between the first and third fluid ports; and an expansible air chamber operatively connected to the fifth fluid port so as to allow the bidirectional passage of air through the body lumen between the air chamber and fourth fluid port;

(b) with the fluid regulating element in the first position, engaging the syringe containing the liquid with the device body so as to be in fluid communication with the first fluid port, and engaging the vial with the device body so as to be in fluid communication with the second and fourth fluid ports;

(c) moving the fluid regulating element to the second position;

(d) injecting the liquid from the syringe into the vial through the first fluid port, the interior cavity, and the second fluid port to create a reconstituted medicament;

(e) withdrawing the reconstituted medicament from the vial into the syringe through the second fluid port, the interior cavity, and the first fluid port;

(f) moving the fluid regulating element to the third position; and (g) expelling the reconstituted medicament from the syringe out of the device body through the first fluid port, the interior cavity, and the third fluid port.

21. The method of claim 20, wherein the vial contains a volume of air, and wherein air is displaced from the vial into the expansible air chamber through the fourth fluid port, the body lumen, and the fifth fluid port during the step of injecting the liquid from the syringe into the vial.

22. The method of claim 21, wherein air is transferred from the expansible air chamber into the vial through the fifth fluid port, the body lumen, and the fourth fluid port during the step of withdrawing the reconstituted medicament from the vial into the syringe.

23. The method of claim 20, wherein the device body is configured for attachment of an IV line thereto so as to be in fluid communication with the third fluid port, and wherein the step of expelling includes the introduction of the reconstituted medicament into the IV line through the third fluid port.

* * * * *